United States Patent [19]

Planakis

[11] 4,155,550

[45] May 22, 1979

[54] OFFSET GAME RACKET

[76] Inventor: Leo N. Planakis, 1701 Pebble Beach Dr., Vienna, Va. 22180

[21] Appl. No.: 815,836

[22] Filed: Jul. 14, 1977

[51] Int. Cl.[2] ..... A63B 49/02

[52] U.S. Cl. ..... 273/73 C

[58] Field of Search ..... 273/26 B, 29 A, 67 R, 273/67 D, 67 DA, 72 R, 73 R, 73 C, 73 J, 75, 76, 81.3, 96 R; 294/7, 57-59; 15/141 R; D34/5 SP, 5 BC, 5 ST

[56] References Cited

U.S. PATENT DOCUMENTS

| | | | |
|---|---|---|---|
| D. 164,883 | 10/1951 | Schmid | 273/76 X |
| 335,656 | 2/1886 | Taylor | 273/73 R |
| 1,801,672 | 4/1931 | Knowles | 294/7 |
| 2,421,339 | 5/1947 | Leger | 273/81.3 X |
| 3,767,249 | 10/1973 | Rogers | 294/57 X |
| 3,954,265 | 5/1976 | Taylor | 273/167 G X |
| 4,038,719 | 8/1977 | Bennett | 273/81.3 X |

FOREIGN PATENT DOCUMENTS

| | | | |
|---|---|---|---|
| 11067 of | 1912 | United Kingdom | 273/73 R |

*Primary Examiner*—Richard J. Apley
*Attorney, Agent, or Firm*—Charles E. Brown

[57] ABSTRACT

This relates to a game racket, such as a tennis racket, wherein the hand grip portion of the handle is both offset from the general plane of the head and also disposed at an angle thereto. The handle is so configurated with respect to the head wherein the center of gravity is along the axis of the hand grip portion to provide for a balanced condition. This arrangement of the handle with respect to the head permits a greater moment of inertia, by which a greater stability is obtained, particularly one against twisting of the racket in one's hand when the ball is struck off-center of the head; that is, on either side of the longitudinal axis of the racket head. Further, by off-setting the handle, a greater arc of stroke is possible, thereby permitting a struck ball to be repelled with a higher velocity.

7 Claims, 3 Drawing Figures

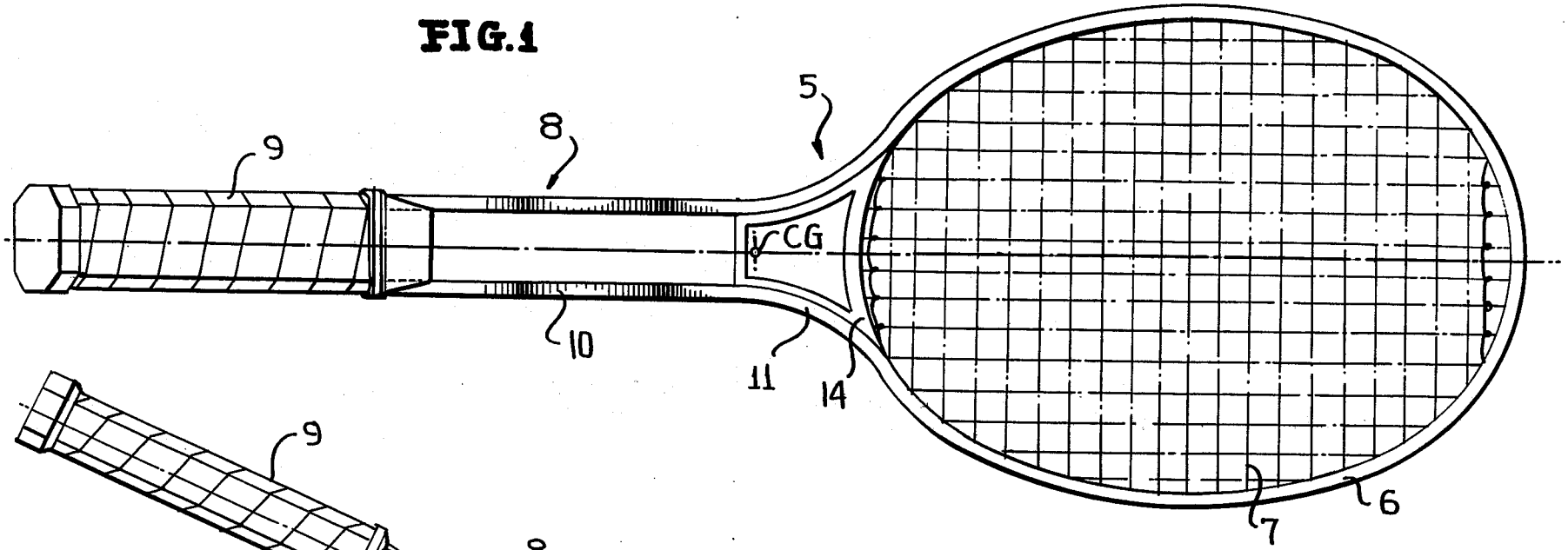
FIG.1
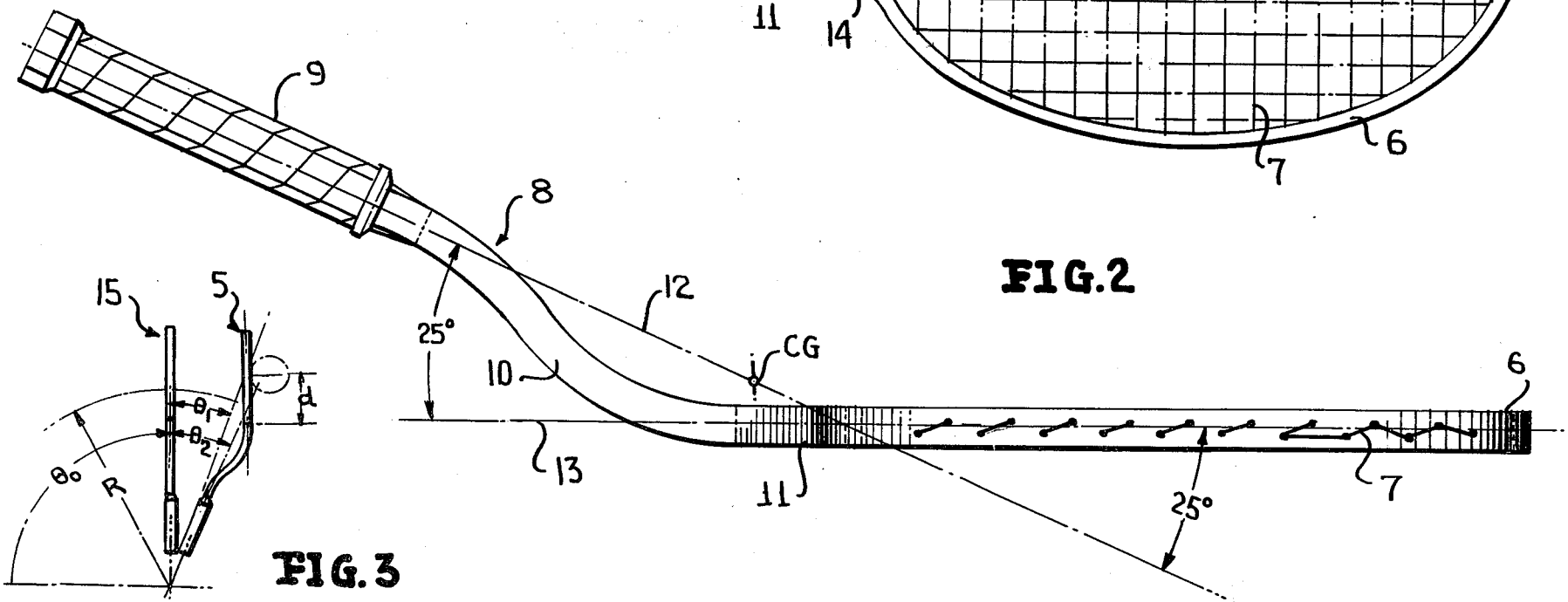
FIG.2
FIG.3

OFFSET GAME RACKET

This invention relates in general to new and useful improvements in sports equipment, and more particularly to a novel game racket with particular reference being made to tennis rackets.

Essentially all tennis rackets in use today are planar. This invention relates specifically to a non-planar, offset tennis racket, and to offset game rackets in general. In accordance with the present invention, the offset tennis racket mitigates various disadvantages of the conventional planar tennis racket and at the same time produces new and useful improvements which will benefit all players.

For years, tennis rackets have been generally of similar shape and size with little significant variation. In recent years an attempt has been made to increase the effective striking area of a racket by increasing the size of the head. The net result is an oversize tennis racket which some have found less wieldable, but which does enable the less skilled player to return more balls accurately. Such a tennis racket is disclosed in the patent to Head, U.S. Pat. No. 3,999,756.

In accordance with this invention, the handle of the racket is offset with respect to the racket head with the grip portion having an axis disposed at an angle relative to the general plane of the head, and the shank and the throat portion of the handle being offset to one side of that axis from the majority of the head so that the center of gravity of the racket lies on or near the axis of the hand grip.

In the patent to Taylor, U.S. Pat. No. 335,656 of Feb. 9, 1886, it was proposed to provide an offset racket. However, the purpose of such a racket was to change the relation of the handle to the head of the racket so as to aid those players who had difficulty in striking a ball close to the ground or who had difficulty in striking a ball above the level of their heads. However, all of the various forms of offset rackets shown in U.S. Pat. No. 335,656 are unbalanced, and it was intended that the inside face of the racket head be used to strike the tennis ball. Furthermore, Taylor finds that the offset angle is not material.

All conventional planar rackets are naturally balanced with respect to their longitudinal axis because the mass of such a racket is distributed symmetrically about the longitudinal axis. The same is not true for an asymmetrical tennis racket such as the racket of the present invention. On the contrary, any asymmetrical tennis racket will be naturally unbalanced unless provision is made to compensate for the asymmetrical distribution of mass about the longitudinal axis of the hand grip. The disadvantages of an unbalanced racket are obvious. Balance is achieved in accordance with the present invention by having the longitudinal axis of the hand grip pass through or near the center of gravity of the racket.

Contrary to the teaching of U.S. Pat. No. 335,656, the offset angle is material to the present invention. Analysis has indicated that, with the vertex of the offset angle located near the base of the racket head frame, an offset angle of approximately 20° will produce the greatest increase in tennis ball velocity, and that an offset angle of more than 40° will usually result in a decrease in tennis ball velocity (as compared to a conventional planar tennis racket).

In accordance with this invention the handle of a racket is offset with respect to the head with the grip portion having an axis disposed at an angle relative to the general plane of the head and the shank and throat portion of the handle being offset to one side of that axis from the majority of the head so that the center of gravity of the racket lies along the axis of the hand grip portion.

It is an object of the present invention to provide a tennis racket which will have a greater moment of inertia than that of a conventional planar racket of similar mass and dimensions. A greater moment of inertia will reduce the tendency of a racket to twist in a player's hand when a ball is struck on either side of the racket head center-line.

The manner in which these and other objects of this invention is attained will be made clear by consideration of the following specification and claims when taken in conjunction with the drawings.

IN THE DRAWINGS

FIG. 1 is a plan view of a tennis racket formed in accordance with this invention;

FIG. 2 is a side elevational view of the tennis racket of FIG. 1; and

FIG. 3 is a schematic view on a reduced scale showing the difference in positions of a planar racket and the racket of this invention when striking a ball.

Referring now to the drawings in detail, it will be seen that there is illustrated in FIG. 1 a tennis racket which is formed in accordance with this invention, the tennis racket being generally identified by the numeral 5. The racket 5 includes the usual head 6 carrying strings 7 in the customary manner.

The racket 5 also includes a handle, generally identified by the numeral 8. The handle 8 is provided remote from the head 6 with a hand grip portion 9 which is conventional. The handle 8 also includes a shank portion 10 which connects the hand grip portion 9 to a base portion 14 of the head 6 through a throat area 11.

In plan, the racket 5 has the appearance of a conventional racket which lies generally in a single plane. However, as shown in FIG. 2, the handle 8 is offset relative to the head 6 and while the head 6 lies in a general plane in the normal manner, the hand grip portion 9 has a primary axis 12 which is disposed in angular relation to the general plane of the head 6, that general plane being identified by the numeral 13. In the illustrated form of racket the angle between the axis 12 and the plane 13 is 25°. This angle may vary between 3° and 40°, with the preferred range being on the order of 15°–25°.

The racket 5 has a center of gravity CG which, in accordance with this invention, must be along or near the axis 12. The CG is maintained along the axis 12 by offsetting the shank portion 10 and the throat area 11 to one side of the axis 12 while a major portion of the head 6 is disposed at the opposite side of the axis 12. It is to be understood that once it is determined what the angle of the axis 12 and its point of intersection with the plane 13 should be, the configuration and mass of the shank 10 and the throat area 11 may be modified accordingly to position the CG along or near the axis 12.

It has been found that the preferred location of the CG is along the axis 12 between the hand grip portion 9 and the point where the axis 12 intersects the plane 13.

A greater moment of inertia will reduce the tendency of a racket to twist in a player's hand when a ball is struck on either side of the racket head centerline. With particular reference thereto, the evaluation of the moment of inertia (I) of a body of irregular shape is quite difficult. However, for a body of simple (regular) shape, it is relatively simple. For example, let a circle of radius R represent the head of a conventional tennis racket. The moment of inertia about the y axis (a diameter of the circle) is given by:

$$I_1 = \int_0^{2\pi} x^2\, ds$$

where $x^2 = R^2 \cos^2\theta$ and $ds = Rd\theta$ $$\therefore I_1 = R^3 \int_0^{2\pi} \cos\theta d\theta$$

$$= R^3\left(\frac{\theta}{2} + \frac{\sin_2\theta}{4}\right) \Big|_0^{2\pi} = \pi R^3$$

Now, let a circle of radius R represent the head of an offset tennis racket in a plane which forms an angle $\phi$ with the usual xy plane. With the circle center on the usual z axis and the y axis intersecting the circle circumference, the moment of inertia about the y axis is given by:

$$I_2 = \int_0^{2\pi} (x^2 + z^2)\, ds$$

where $x^2 = R^2 \cos^2\theta$ $z^2 = R^2 (1 + \sin\theta)^2 \sin^2\phi$ and $ds = Rd\theta$ $$\therefore I_2 = R^3\left[\int_0^{2\pi} \cos^2\theta d\theta + \sin^2\phi \int_0^{2\pi} (1 + 2\sin\theta + \sin^2\theta) d\theta\right]$$

$$= R^3\left[\frac{\theta}{2} + \frac{\sin_2\theta}{4} + \sin^2\phi\left(\theta - 2\cos\theta + \frac{\theta}{2} - \frac{\sin 2\theta}{4}\right)\right]\Big|_0^{2\pi}$$

$$= R^3\left[\frac{2\pi}{2} + 0 + \sin^2\phi\,(3\pi - 2 + 0) - \sin^2\phi\,(-2)\right]$$

$$= R^3\left[\pi + 3\pi\sin^2\phi\right] = \pi R^3 (1 + 3\sin^2\phi)$$

$$\frac{I_2}{I_1} = \frac{\pi R^3(1 + 3\sin^2\phi)}{\pi R^3}$$

$$\frac{I_2}{I_1} = 1 + 3\sin^2\phi$$

For $\phi = 22°$, $I_2 = 1.42 I_1$ (42% increase)

For $\phi = 25°$, $I_2 = 1.54 I_1$ (54% increase)

For angle between the plane of the racket head and the longitudinal axis of the hand grip portion enables a player to put much more spin on a tennis ball during a serve which results in a greater hook or slice.

The offset angle of the racket head also enables a player to strike the ball in a more forward position thereby making it easier for the player to keep his eye on the ball with a resulting better ball control. In order to understand this, reference is made to FIG. 3.

Let $\theta_1$ be the angle between the radius of stroke and plane of the head of the offset racket 5 when contact is made with the ball. Therefore, for conventional racket 15, the length of arc of a circular stroke (based on center of head) equals $R\theta_o$, and for the racket of the present invention (based on center of head) equals $R(\theta_o+\theta_2)$ where $\theta_2$ is a function of $\theta_1$, d, and R. However, since the offset racket head 6 is not normal to the velocity vector, V, when contact is made with the ball, but differs by the angle $\theta_1$, the effective component of velocity equals V cos $\theta_1$. Assuming constant acceleration, equal radii, R, and rackets of equal mass, it has been determined that the ratio of the effective momentum of the offset racket 5 to that of a conventional planar racket 15 is equal to $[\theta_0+\theta_2/\theta_0]^{\frac{1}{2}} \cos\theta_1$. With $\theta_0 = 90°$ and $\theta_2 = 20°$ (an optimum angle), the increase in effective momentum of the offset racket 5 will be approximately six percent (as compared to a conventional planar racket 15), assuming d/R = 0.2. As the value of $\theta_0$ is increased to 120°, the increase in effective momentum reduces to approximately four percent. The increase in effective momentum is equivalent to the increase in velocity with which the racket of this invention will repel a tennis ball (as compared to a conventional planar racket).

Although this invention has been specifically illustrated and described with respect to a tennis racket, it is also to be understood that the principles of this invention are applicable wholly or in part to many other types of rackets and paddles including, but not limited to those intended for squash, badminton, racquetball, and table tennis. It is to be understood that the racket is equally usable by both right-handed and left-handed players.

Although only a preferred embodiment of the racket has been specifically illustrated and described herein, it is to be understood that minor variations may be made in the racket configuration and construction without departing from the spirit and scope of the invention as defined by the appended claims.

I claim:

1. A new article of manufacture comprising a game racket, said racket including a head and a handle, said handle being joined to a base portion of said head, said handle including a grip portion, said head having a primary striking face, said head and said primary striking face lying in a general plane, said grip portion having a primary axis disposed in angular relation to said general plane with said primary striking face facing away from said handle, and said racket having a center of gravity disposed substantially along said axis, said base portion of said head joining said handle in a throat area, and said axis intersecting said general plane generally adjacent said head base portion.

2. The racket of claim 1 wherein said center of gravity is generally at the point between the grip portion and that point where said axis intersects said general plane.

3. The racket of claim 1 wherein said axis intersects said head generally at said throat area.

4. The racket of claim 3 wherein the angle between said axis and said general plane is generally on the order of 20°.

5. The racket of claim 1 wherein the angle between said axis and said general plane is generally between 3° and 40°.

6. The racket of claim 1 wherein the angle between said axis and said general plane is generally on the order of 15° to 25°.

7. The racket of claim 1 wherein said handle includes a shank joined to said head in said throat area, and the shape and mass of said shank and throat area are selected to position said center of gravity substantially along said axis.

* * * * *